US007967611B2

(12) United States Patent
Bailleul et al.

(10) Patent No.: US 7,967,611 B2
(45) Date of Patent: Jun. 28, 2011

(54) ELECTRICAL INTERCONNECT AND METHOD FOR ELECTRICALLY COUPLING A PLURALITY OF DEVICES

(75) Inventors: Patrick Kevin Bailleul, Whittier, CA (US); Steven Edward Bradshaw, West Hills, CA (US); David Matthew Hudson, Redondo Beach, CA (US); Luke Andrew Hardman, Hermosa Beach, CA (US)

(73) Assignee: The Boeing Company, Chicago, IL (US)

( * ) Notice: Subject to any disclaimer, the term of this patent is extended or adjusted under 35 U.S.C. 154(b) by 93 days.

(21) Appl. No.: 12/366,801

(22) Filed: Feb. 6, 2009

(65) Prior Publication Data

US 2010/0203771 A1 Aug. 12, 2010

(51) Int. Cl.
*H01R 12/00* (2006.01)

(52) U.S. Cl. ..... 439/63; 439/581; 333/260

(58) Field of Classification Search ..... 439/63, 439/581, 66, 74; 333/260, 33
See application file for complete search history.

(56) References Cited

U.S. PATENT DOCUMENTS

| | | | | |
|---|---|---|---|---|
| 4,588,241 | A | 5/1986 | Ardezzone | |
| 4,707,039 | A | 11/1987 | Whipple | |
| 4,740,746 | A * | 4/1988 | Pollock et al. | 324/761 |
| 4,961,709 | A | 10/1990 | Noschese | |
| 5,380,211 | A * | 1/1995 | Kawaguchi et al. | 439/74 |
| 5,886,590 | A * | 3/1999 | Quan et al. | 333/33 |
| 5,928,000 | A * | 7/1999 | Rudisill et al. | 439/63 |
| 5,936,421 | A | 8/1999 | Stowers et al. | |
| 6,039,580 | A | 3/2000 | Sciarretta et al. | |
| 6,094,115 | A * | 7/2000 | Nguyen et al. | 333/260 |
| 6,275,054 | B1 | 8/2001 | Boyle | |
| 6,417,747 | B1 | 7/2002 | Dearden et al. | |
| 6,462,570 | B1 | 10/2002 | Price et al. | |
| 6,639,154 | B1 | 10/2003 | Cartier et al. | |
| 6,677,772 | B1 * | 1/2004 | Faull | 324/761 |
| 6,882,247 | B2 | 4/2005 | Allison et al. | |
| 6,958,670 | B2 | 10/2005 | Winslow et al. | |
| 7,053,640 | B2 | 5/2006 | Feld et al. | |
| 7,183,781 | B2 | 2/2007 | LaMeres et al. | |
| 7,262,590 | B2 | 8/2007 | Nakajima | |
| 7,377,822 | B1 | 5/2008 | Shen | |
| 7,416,418 | B2 * | 8/2008 | Berthet et al. | 439/66 |
| 2003/0042883 | A1 | 3/2003 | Thurston et al. | |
| 2004/0061513 | A1 | 4/2004 | Sweet et al. | |

FOREIGN PATENT DOCUMENTS

WO 2005053107 A1 6/2005

OTHER PUBLICATIONS

International Search Report and Written Opinion of PCT/US2010/023147; Jun. 29, 2010; 11 pages.

* cited by examiner

*Primary Examiner* — Xuong M Chung Trans
(74) *Attorney, Agent, or Firm* — Armstrong Teasdale LLP

(57) ABSTRACT

An electrical interconnect system includes a first circuit board that includes at least one via, and a conductor configured to transmit an electrical current therethrough. The conductor includes a first signal contact extending from a conductor first end, and a dielectric cylinder configured to receive the conductor therethrough. The dielectric cylinder includes a first bellows element extending from a first end of the dielectric cylinder that is positioned adjacent to the first signal contact. The first bellows element and the dielectric cylinder are configured to form a substantially continuous outer conductor, wherein the conductor and the first bellows are configured to electrically interface to the via and maintain connection thereto using a biasing force.

20 Claims, 6 Drawing Sheets

ELECTRICAL INTERCONNECT AND METHOD FOR ELECTRICALLY COUPLING A PLURALITY OF DEVICES

BACKGROUND

The field of the disclosure relates generally to electronic components, and more particularly, to coaxial interconnects for use in electrically coupling a plurality of devices.

The continued reduction in size of radio frequency (RF) and other electrical components creates a need for compact RF connections that meet both electrical and mechanical requirements. Some known applications require an RF interconnection between adjacent components, and more specifically between two circuit boards. The adjacent components may be substrates or circuit boards comprising layers in a stacked assembly. Such known connectors suitable for RF connections may also be suitable for digital and other low frequency signals.

RF interconnects may be used to connect a mating portion of one component to a corresponding mating portion of another component. The corresponding mating portions may comprise elements of a grid pattern of one or both components. Some known interconnects may use compressed wire bundle interconnect structures that are available with internal pins for DC and low frequency signals. However, conventional techniques of receiving the pin typically require the pin itself to have a larger diameter than that of the wire bundle contact. Also, epoxies may be used to hold the pin and dielectric elements of the interconnect structure together. The combination of all these process steps makes the objectives of maintaining control and uniform impedance at super high frequencies difficult if not impossible. Additionally, some other known coaxial connectors typically employ a barb machined onto the pin to hold it in place within the dielectric. However the outer conductor must be modified using complex machining to maintain good impedance control.

SUMMARY

In one aspect, an electrical interconnect system is provided. The system includes a first circuit board that includes at least one via, and a conductor configured to transmit an electrical current therethrough. The conductor includes a first signal contact extending from a conductor first end, and a dielectric cylinder configured to receive the conductor therethrough. The dielectric cylinder includes a first bellows element extending from a first end of the dielectric cylinder that is positioned adjacent to the first signal contact. The first bellows element and the dielectric cylinder are configured to form a substantially continuous outer conductor, wherein the conductor and the first bellows are configured to electrically interface to the via and maintain connection thereto using a biasing force.

In yet another aspect, an electrical interconnect device is provided. The electrical interconnect device includes a conductor configured to transmit an electrical current therethrough, wherein the conductor includes a first signal contact extending from a conductor first end. The electrical interconnect device includes a dielectric cylinder configured to receive the conductor therethrough, wherein the dielectric cylinder includes a first bellows element extending from a first end of said dielectric cylinder and positioned adjacent said first signal contact. The first bellows element and the dielectric cylinder are configured to form a substantially continuous outer conductor, and to electrically interface to the via and maintain connection thereto using a biasing force.

In yet another aspect, a method for coupling two circuits is provided. The method includes providing an electrical conductor configured to transmit an electrical current therethrough, wherein the conductor includes a first signal contact extending from a conductor first end and extending the electrical conductor within a dielectric cylinder such that the dielectric conductor substantially circumscribes the electrical conductor. The method includes extending a first bellows element from a first end of the dielectric cylinder such that a substantially continuous outer conductor is formed between the first bellows element and the dielectric cylinder and such that the first bellows element is positioned adjacent to the first signal contact and forms a compressible interface therewith. The method includes positioning the electrical conductor between a first and second circuit, wherein the conductor and the first bellows are configured to electrically interface to a circuit board via.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

Figure 1:
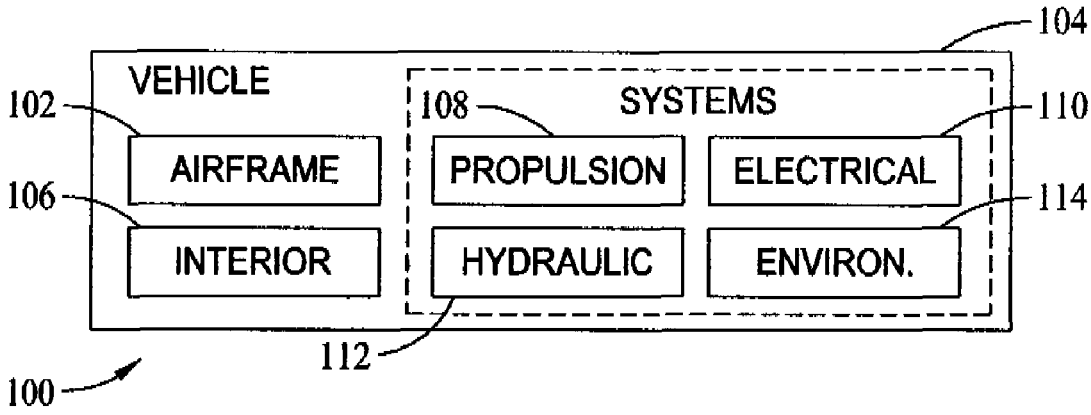
FIG. 1 is a system block diagram of an exemplary vehicle.

Referring more particularly to the drawings, embodiments of the disclosure may be described in the context of a vehicle 100 as shown in FIG. 1. In the exemplary embodiment, vehicle 100 is a satellite, as described in more detail herein. Alternatively, vehicle 100 may be any vehicle having an electrical configuration similar to what is described herein. As shown in FIG. 1, the satellite 100 may include a frame 102 with a plurality of systems 104 and an interior 106. Examples of high-level systems 104 include one or more of a propulsion system 108, an electrical system 110, a hydraulic system 112, and an environmental system 114. Any number of other systems may be included. Although an aerospace example is shown, the principles of the disclosure may be applied to other industries, such as the automotive industry.

Figure 2:
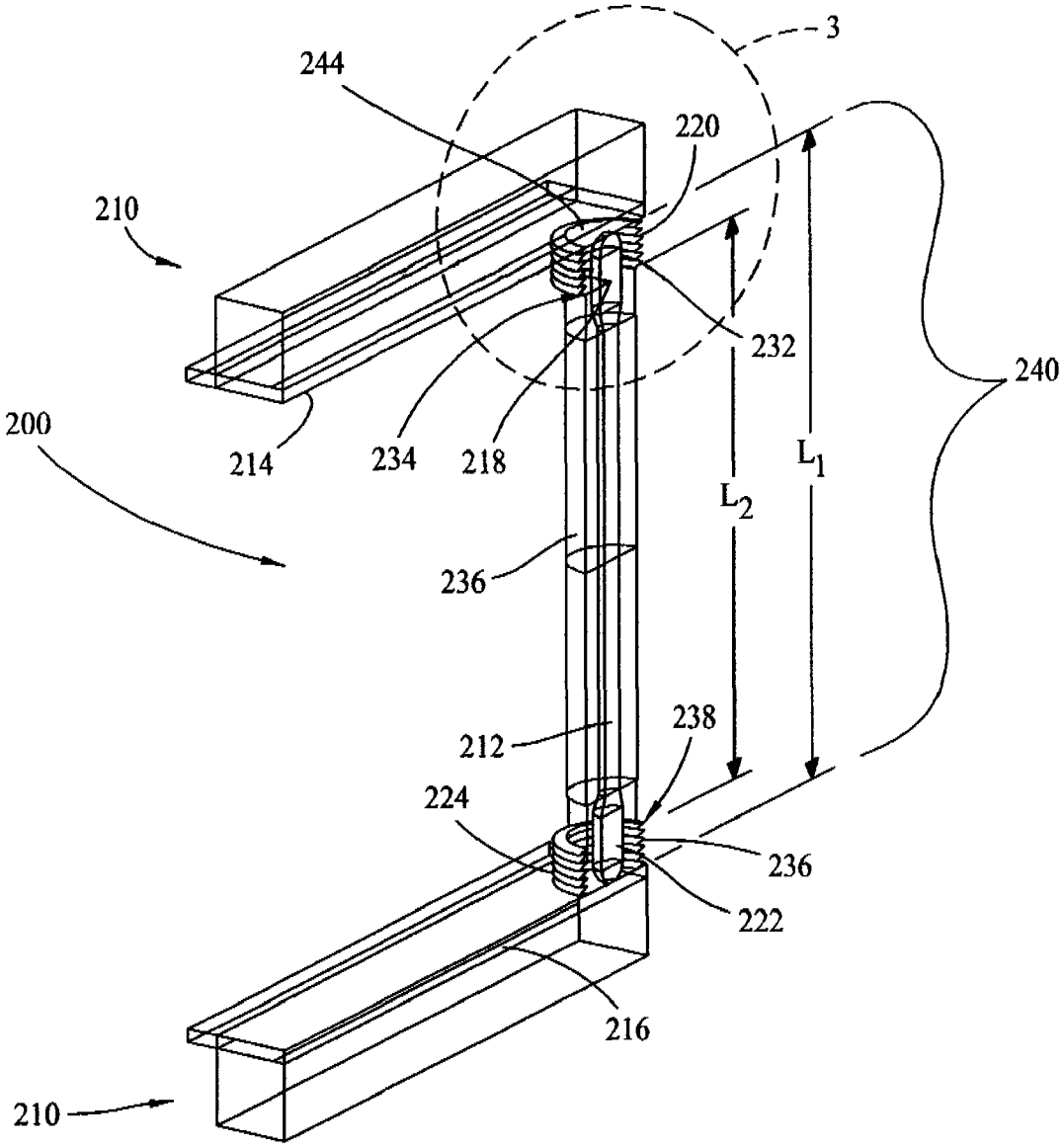
FIG. 2 is a perspective view of an exemplary RF interconnect used to electrically couple multiple exemplary circuits.
Figure 3:
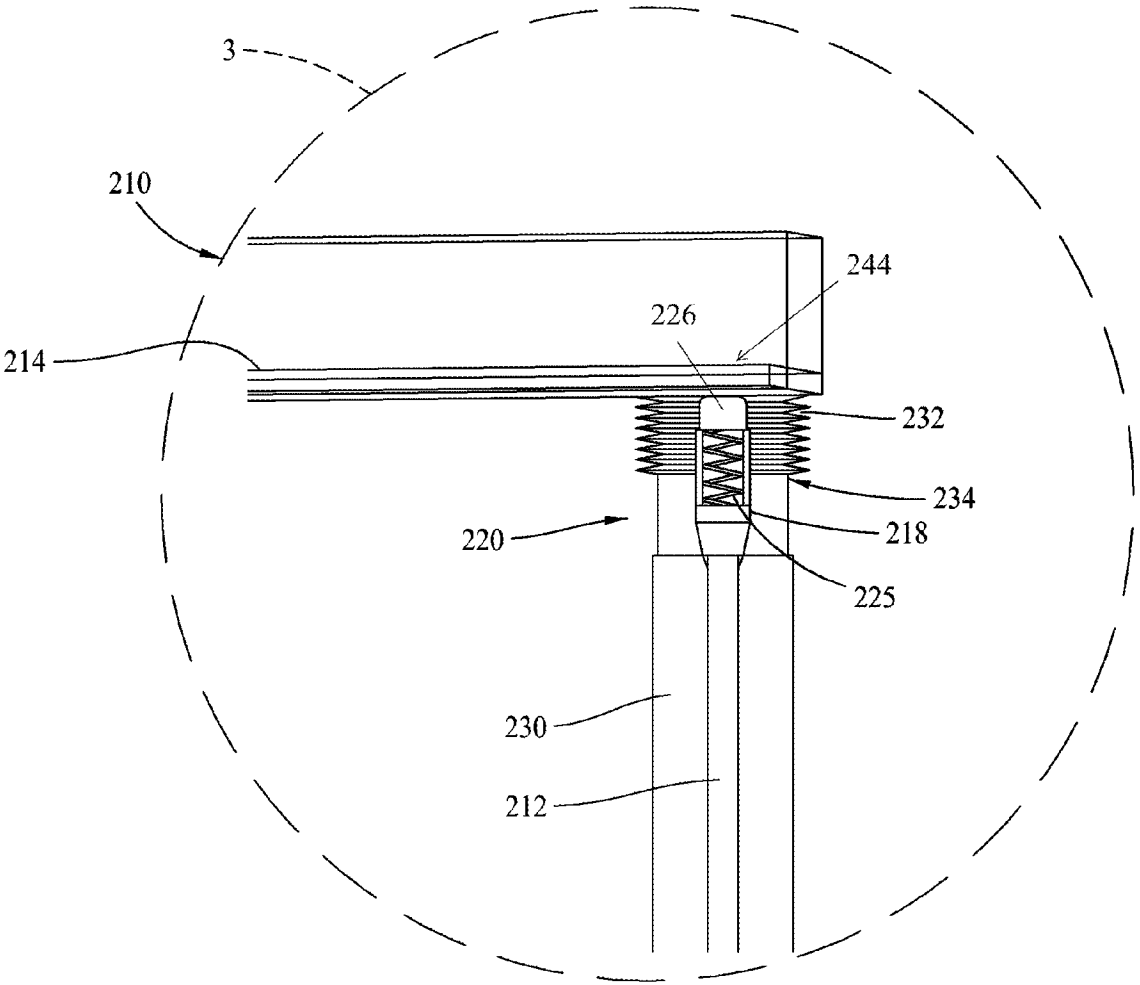
FIG. 3 is a front elevational view of area 3 shown in FIG. 2.
Figure 4:
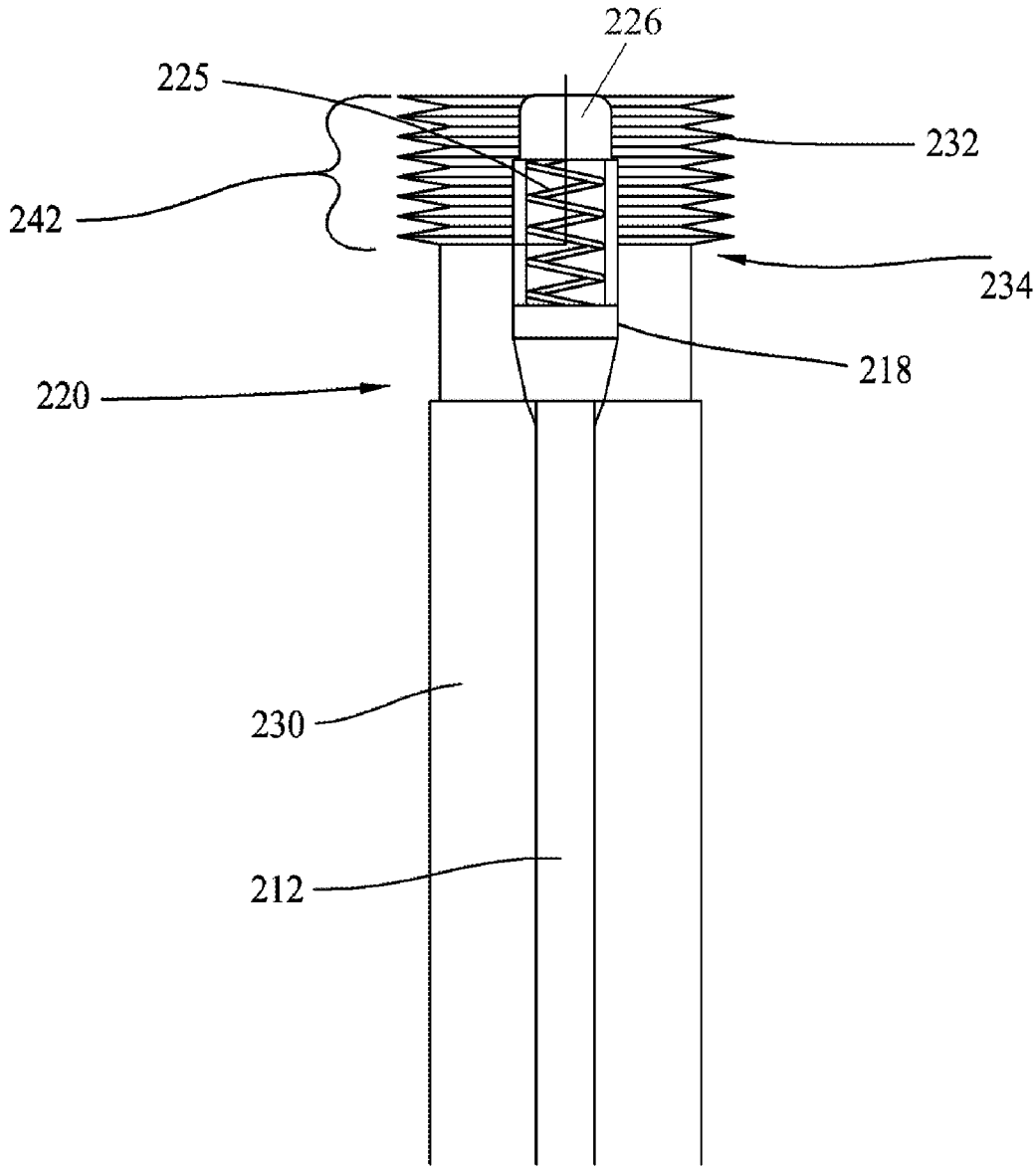
FIG. 4 is a partial front elevational view of the exemplary RF interconnect shown in FIG. 2.

FIG. 2 is a perspective view of an exemplary RF interconnect 200 used to electrically couple multiple exemplary circuits 210. FIG. 3 is a front elevational view of area 3 shown in FIG. 2, and FIG. 4 is a partial front elevational view of the exemplary RF interconnect 200 shown in FIG. 2. In the exemplary embodiment, RF interconnect 200 includes a coaxial cable 212 that extends a length $L_1$ between a first circuit board 214 and a second circuit board 216, and serves to electrically couple first circuit board 214 with second circuit board 216. More specifically, and in the exemplary embodiment, coaxial cable 212 includes a first signal contact 218 coupled to a first end 220 of coaxial cable 212, and a second signal contact 222 coupled to a second end 224 of coaxial cable 212. First signal contact 218 and second signal contact 222 are sized and oriented to interface with one or more of flat contact pads or vias 244 within respective circuit boards 214 and 216, as described in more detail herein.

As shown in FIGS. 3 and 4, in the exemplary embodiment, first signal contact 218 includes an internal spring 225 that exerts a biasing force against signal contact plug 226, which is sometimes referred to herein as a spring-biased plug. The embodiment of signal contact plug 226 shown in FIGS. 3 and 4 is one type of plug for engaging a flat contact pad on a circuit board. Alternatively, coaxial cable 212 may include any type of connection element that enables RF interconnect to function as described herein. In an alternative embodiment, coaxial cable 212 may be configured to electrically couple a single circuit board to any other electrical component, such as connecting an RF module with a circuit board, or such as connecting two RF modules.

In the exemplary embodiment, RF interconnect 200 includes a shield 230 that is positioned externally about and at least partially circumscribes coaxial cable 212. Shield 230 extends a length $L_2$ over coaxial cable length $L_1$, wherein in the exemplary embodiment, $L_2$ is less than $L_1$. A first bellows element 232 is coupled to a first end 234 of shield 230 and extends outward therefrom and is positioned to substantially surround first signal contact 218. A second bellows element 236 is coupled to a second end 238 of shield 230 and extends outward therefrom and is positioned to substantially surround second signal contact 222. In the exemplary embodiment, first bellows element 232 and second bellows element 236 are fabricated from a conducting metal, such as for example, aluminum, gold, silver or copper, or any conductive metal that enables RF interconnect 200 to function as described herein. Bellows elements 232 and 236 are positioned on respective first and second ends 234 and 238 of shield 230 and a substantially continuous dielectric cylinder 240, shown in FIG. 2, extends between first circuit board 214 and second circuit board 216, separating bellows elements 232 and 236 and shield 230 from contacts 218 and 222.

Referring to FIG. 4, in the exemplary embodiment, a combination of signal contact 218 and bellows element 232 forms a compressible coaxial connector 242 that maintains contact with respective circuit board 214 through the biasing force exerted by internal spring 225 and bellows element 232. During operation, RF interconnect 200 is positioned between, and electrically couples first and second circuit boards 214 and 216 to each other. More specifically, the combination of signal contact 218 and respective bellows element 232 engages circuit board 214 at contact pads proximate via 244 and provides a compressible coaxial electrical connection between circuit boards that, during operation, may have a variable distance therebetween. As used herein, "via" refers to a conducting pathway between two or more substrates (layers).

RF interconnect 200 may vary in length while maintaining RF performance over a range of compression. In the exemplary embodiment, $L_1$ represents a gap measuring approximately 0.8 inches, and RF interconnect allows a total compression inward of approximately 0.050 inches, or approximately a 6.25% range of compression from coaxial cable length $L_1$. Alternatively, RF interconnect may allow any range of compression that enables circuit boards 214 and 216 to function as described herein.

Figure 5:
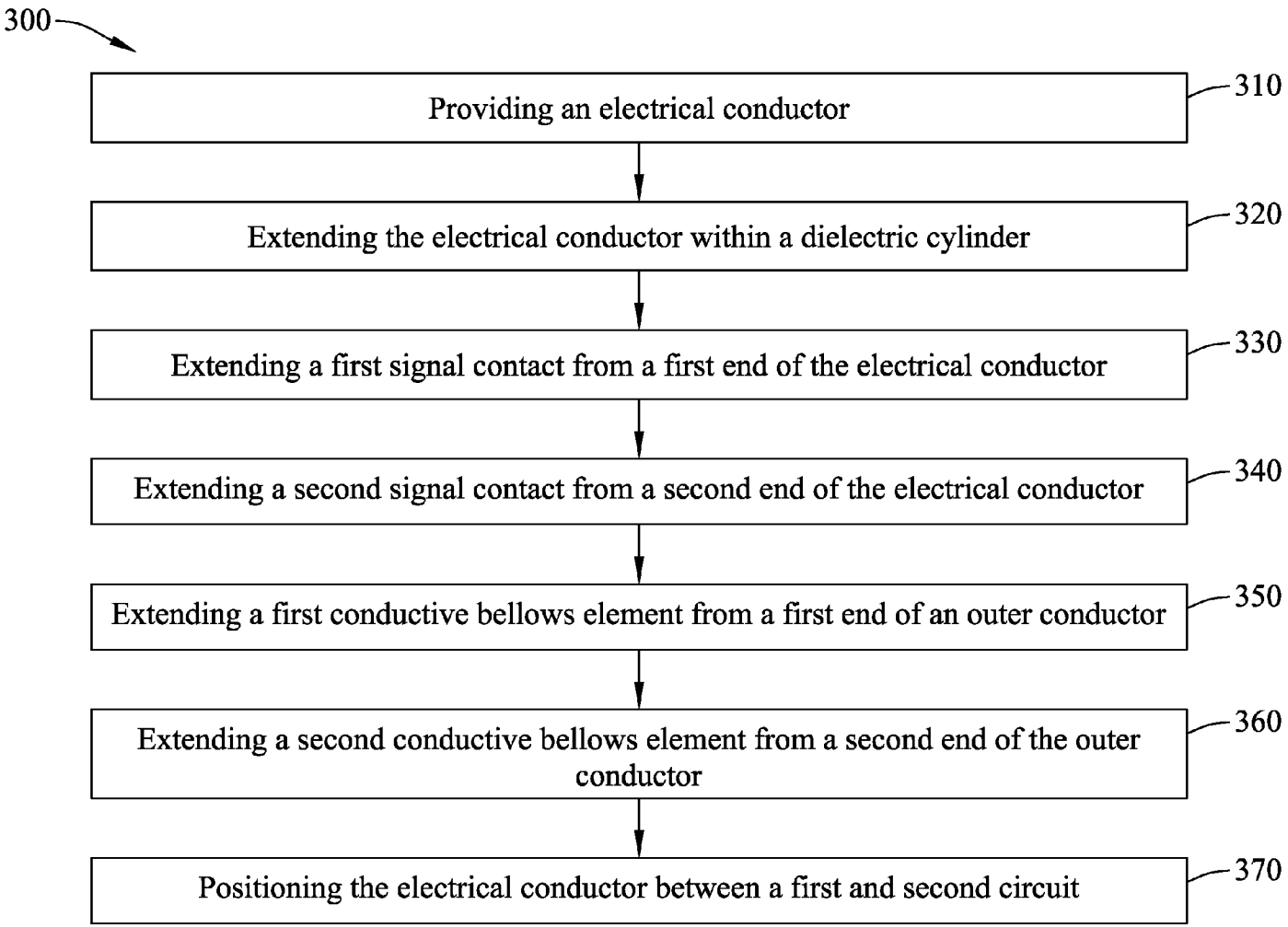
FIG. 5 is a flow diagram of a method for coupling multiple circuits using exemplary RF interconnect, shown in FIG. 2.

FIG. 5 is a flow diagram of a method 300 for coupling multiple circuits using exemplary RF interconnect 200, shown in FIG. 2. In the exemplary embodiment, method 300 includes providing 310 an electrical conductor that is configured to transmit an electrical current therethrough and extending 320 the electrical conductor within a dielectric cylinder such that the dielectric cylinder substantially circumscribes the electrical conductor. A first signal contact is extended 330 from a first end of the conductor, and a second signal contact is extended 340 from a second end of the conductor. Moreover, a spring-biased plug 226 is positioned within the electrical conductor that is configured to engage a circuit board contact.

In the exemplary embodiment, a first bellows element is extended 350 from a first end of the shield such that a substantially continuous outer conductor is formed by the first bellows element and the shield, and such that the first bellows element is positioned adjacent to the first signal contact and forms a compressible interface therewith. Furthermore and in the exemplary embodiment, method 300 includes extending 360 a second bellows element from a second end of the shield such that a substantially continuous outer conductor is formed between the second bellows element and the shield and such that the second bellows element is positioned adjacent to the second signal contact and forms a compressible interface therewith. More specifically, extending 350 a first and extending 360 a second bellows element further includes fabricating the first and the second bellows element from a material that is configured to compress under an inward load and provide a biasing force to maintain respective first and second conductors in contact with the respective contacts on the circuit board via.

Figure 6:
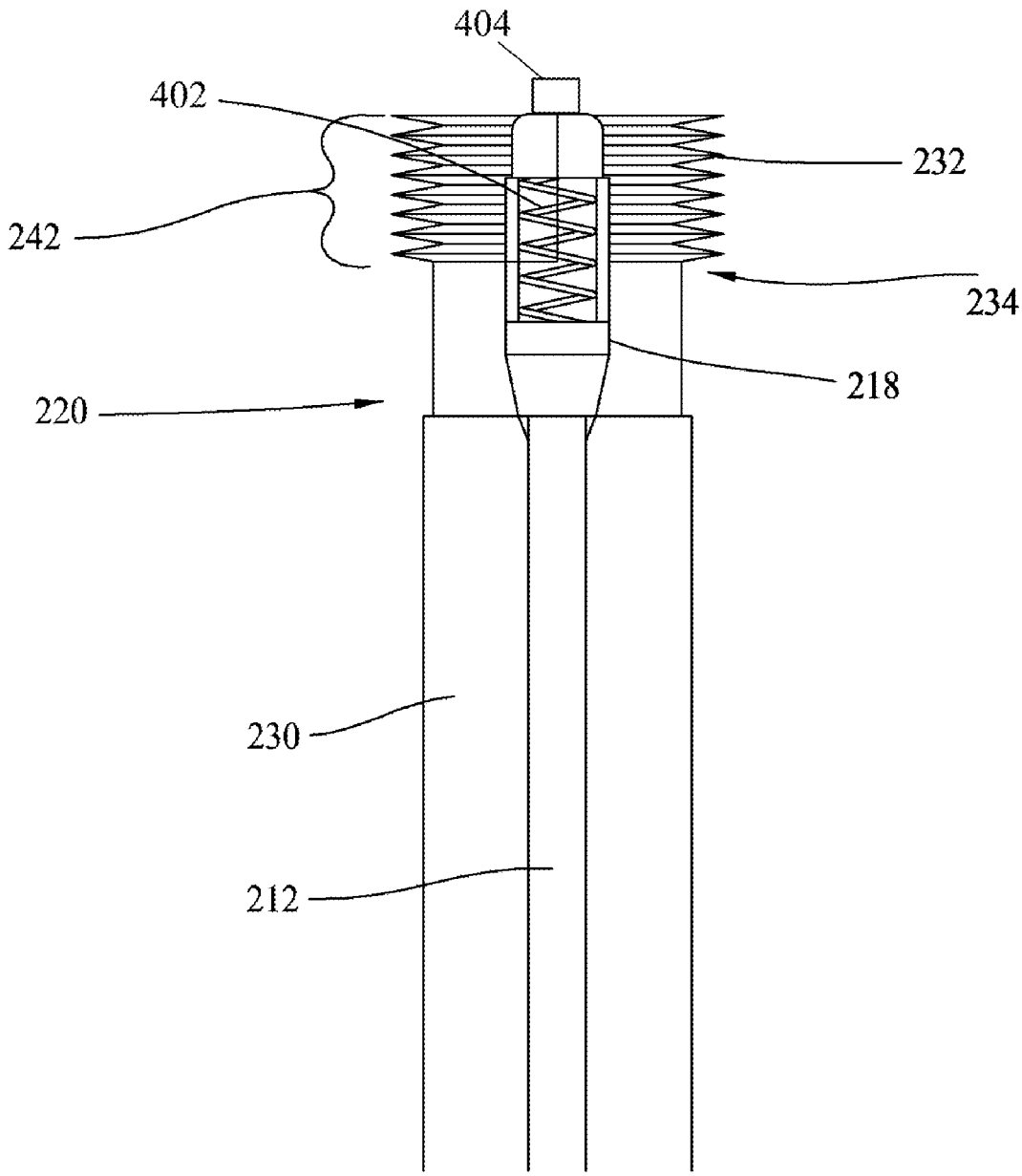
FIG. 6 is a front elevational view of an alternative embodiment of RF interconnect.

As shown in FIG. 6, in an alternative embodiment, first signal contact 400 includes an internal spring 402 that exerts a biasing force against signal contact plug 404, which is configured for axial movement with respect to the remainder of first signal contact 400 so that plug 404 may engage a via within a circuit board, though plug 404 is also operable to engage a flat contact pad on a circuit board. The other components shown in FIG. 6 operate in the same fashion and are equivalent to components shown in FIGS. 3 and 4 and are shown with the same reference numerals.

Exemplary embodiments of coaxial RF interconnects are described in detail above. The above-described electrical interconnects facilitate electrically coupling multiple circuits to one another by use of a spring bellows to form a continuous outer conductor or shield about a coaxial transmission line that is compressible and therefore capable of accommodating variability in its length in order to maintain a good electrical connection over a range of compression. When used in combination with a spring loaded contact, the combination facilitates forming a compressible coaxial connector that maintains the electrical connection using a contact biasing force.

Additionally, the RF interconnects described herein provide an interface for flat contact pads or circuit vias and thus does not require mating sockets or pins on the printed circuit boards or RF modules. Such an embodiment may be less expensive, provide a better RF performance and operate over a wider range of compression while being less prone to workmanship errors during installation. The RF interconnects described herein have the capability of providing a high performance, low cost, compressible and repeatable blind-mate coaxial RF interconnection between two circuit elements having a variable distance therebetween. Such assemblies may be used in any application where a compressible, blind mate RF interconnect is desired. This may include, for illustrative purposes only, various aerospace applications such as array connections on a satellite.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention.

Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

Although the apparatus and methods described herein are described in the context of compressible blind mate RF interconnects for use in electrically coupling two electrical components, it is understood that the apparatus and methods are not limited to such applications but may be applied by any application that supplies RF components and subassemblies, along with commercial RF electronics applications. Likewise, the system components illustrated are not limited to the specific embodiments described herein, but rather, system components can be utilized independently and separately from other components described herein.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical interconnect system comprising:

a conductor configured to transmit an electrical current therethrough, said conductor comprising a first signal contact extending from a conductor first end;

a dielectric cylinder configured to receive said conductor therethrough; and an outer shield comprising a first bellows element extending from a first end thereof and positioned about said first signal contact, said first bellows element and said outer shield configured to form a substantially continuous outer conductor;

wherein said conductor and said first bellows are configured to electrically interface to a circuit board and maintain connection thereto using a biasing force.

2. An electrical interconnect system in accordance with claim 1 further comprising:

a second signal contact extending from a second end of said conductor; and a second bellows element extending from a second end of said outer shield and positioned about said second signal contact.

3. An electrical interconnect system in accordance with claim 2 wherein said electrical interconnect system is configured to maintain a substantially constant electrical current flow between the first circuit board and a second circuit board.

4. An electrical interconnect system in accordance with claim 1 wherein said first signal contact comprises a spring-biased plug configured to engage a via in the circuit board.

5. An electrical interconnect system in accordance with claim 2 wherein said first and said second bellows comprises a material configured to compress under an inward load and provide a biasing force to maintain respective said first and said second bellows element in contact with a respective circuit board contact.

6. An electrical interconnect system in accordance with claim 2 wherein said conductor is further configured to transmit a super high frequency radio frequency signal therethrough.

7. An electrical interconnect system in accordance with claim 2, wherein said outer shield is compressible from a first axial length to a second axial length.

8. An electrical interconnect device comprising:

a conductor configured to transmit an electrical current therethrough, said conductor comprising a first signal contact extending from a conductor first end, said first signal contact comprising a spring-biased plug;

a dielectric cylinder configured to receive said conductor therethrough; and an outer shield comprising a first bellows element extending from a first end thereof, said first bellows element and said outer shield configured to form a substantially continuous outer conductor;

wherein said conductor and said first bellows are configured to electrically interface to a circuit board and maintain connection thereto using a biasing force.

9. An electrical interconnect device in accordance with claim 8 further comprising:

a second signal contact extending from a second end of said conductor, said second signal contact comprising a spring-biased plug; and a second bellows element extending from a second end of said outer shield and positioned about said second signal contact.

10. An electrical interconnect device in accordance with claim 9 wherein said electrical interconnect system is configured to maintain a substantially constant electrical current flow between the first circuit board and a second circuit board.

11. An electrical interconnect device in accordance with claim 9 wherein said spring-biased plugs are configured to engage a respective circuit board contact.

12. An electrical interconnect device in accordance with claim 9 wherein said first and said second bellows are configured to compress under an inward load and provide a biasing force to maintain respective said first and said second bellows elements in contact with a respective circuit board contact.

13. An electrical interconnect device in accordance with claim 9 wherein said conductor is further configured to transmit a super high frequency radio frequency signal therethrough.

14. An electrical interconnect device in accordance with claim 9 wherein said outer shield is compressible from a first axial length to a second axial length.

15. A method for coupling a plurality of circuits, said method comprising:

providing an electrical conductor configured to transmit an electrical current therethrough, wherein the conductor includes a first signal contact extending from a conductor first end;

extending the electrical conductor within a dielectric cylinder such that the dielectric conductor substantially circumscribes the electrical conductor;

forming a substantially continuous outer conductor by extending a first bellows element from an outer conductor to substantially surround the dielectric shield, such that the first bellows element is positioned about to the first signal contact and forms a compressible interface therewith; and positioning the electrical conductor between a first and second circuit, wherein the conductor and the first bellows are configured to electrically interface to circuit board contacts.

16. A method in accordance with claim 15 further comprising extending a second bellows element from a second end of the outer conductor such that a substantially continuous outer conductor is formed between the second bellows element and the first bellows element and such that the second bellows element is positioned about to the second signal contact and forms a compressible interface therewith.

17. A method in accordance with claim 16 wherein positioning the electrical conductor between a first and second circuit further comprises maintaining a substantially constant electrical current flow between the first and second circuit board.

18. A method in accordance with claim 16 wherein extending a first and a second bellows element further comprises fabricating the first and the second bellows element from a conductive material configured to compress under an inward load and provide a biasing force to maintain respective first and second bellows elements in contact with the circuit board.

19. A method in accordance with claim 15 further comprising extending a second signal contact from a second end of the conductor.

20. A method in accordance with claim 15 wherein providing an electrical conductor further comprises positioning a spring-biased plug within the electrical conductor configured to engage a circuit board via.

* * * * *